United States Patent [19]

Chiron

[11] 4,186,220

[45] Jan. 29, 1980

[54] CONTROL OF IMPREGNANT OR COATING MATERIAL

[75] Inventor: Georges Chiron, Chambery, France

[73] Assignee: Saint-Gobain Industries, Neuilly-sur-Seine, France

[21] Appl. No.: 862,508

[22] Filed: Dec. 20, 1977

[30] Foreign Application Priority Data

Dec. 21, 1976 [FR] France ..... 76 38466

[51] Int. Cl.[2] ..... B05D 3/12

[52] U.S. Cl. ..... 427/8; 427/346; 427/369

[58] Field of Search ..... 427/8, 346, 369

[56] References Cited

U.S. PATENT DOCUMENTS 2,717,215 9/1955 Faulkner ..... 427/175

3,470,848 10/1969 Dreher ..... 118/410

FOREIGN PATENT DOCUMENTS 2226217 11/1974 France .

547717 9/1942 United Kingdom .

600687 5/1946 United Kingdom .

933664 8/1963 United Kingdom .

1036770 7/1966 United Kingdom .

1090877 11/1967 United Kingdom .

*Primary Examiner*—James R. Hoffman

*Attorney, Agent, or Firm*—Charles H. Lindrooth

[57] ABSTRACT

Impregnated or coated linear material, for example, coated glass fibers, are dried in one or more calibrated spaces which control the percentage of impregnate or coating. A sweeping device moves the material laterally assuring complete sweeping and hence self-cleaning of the calibrated spaces.

6 Claims, 12 Drawing Figures

CONTROL OF IMPREGNANT OR COATING MATERIAL

BACKGROUND OF THE INVENTION

In numerous applications it is necessary to impregnate or coat linear materials such as fibers, strands or textile ribbons, particularly mineral fibers such as glass fibers, with a liquid, for example, an elastomeric emulsion.

Generally, it is necessary that this deposit be regularly distributed on these linear materials which may be done by drying these materials. It is known, in order to carry out this drying operation, to submit the impregnated or coated linear materials to the effects of rollers or pneumatic apparatus.

These drying methods display various inconveniences which this invention proposes to eliminate particularly by doing away with the irregularity of the deposit and the formation of elastic agglomerates adhering to the walls bordering the components used for scooping up excess coating or impregnant.

SUMMARY AND OBJECTS OF THE INVENTION

According to the invention, the impregnated or coated linear materials are dried in at least one calibrated space while they are laterally moved assuring a sweeping of the aforesaid space.

The calibrated spacing controls the percentage of weight of the matter placed on the materials and controls the lateral movement assuring the complete sweeping of the aforesaid space and thus assuring the self-cleaning of this space. The self-cleaning is particularly important where the physical or chemical creation of the dispersed matter is rapid (for example, drying and coagulation of the emulsions).

According to another characteristic of the invention the sweeping motion of the linear materials is begun upstream of the calibrated space.

Another characteristic of the invention consists of:

directing the impregnated linear materials towards at least one pair of rigid components forming a calibrated space between themselves;

introducing the materials into this calibrated space in a direction transverse to these elements;

drying the excess matter while the materials are passing into the aforesaid space; and submitting these materials to a lateral movement which assures the sweeping of the calibrated space.

The lateral sweeping movement of the materials can be a to and fro alternating movement.

According to a particularly advantageous characteristic of the invention the displacement of the linear materials is carried out in the same plane upstream and downstream of the calibrated space, the drying carried out essentially by calendering.

According to one variation, the plane in which the linear materials are moved upstream of the calibrated space is separate from tne plane in which they move downstream, the drying being carried out simultaneously by calendering and by pressure on a component bordering the calibrated space.

According to another characteristic of the invention the linear materials are submitted to a drying comprising a succession of compressions and decompressions facilitating the separation of the excess of the impregnation material. For drying one strand the quantity of matter retained depends particularly on the linear density of the matter, on its form upon its passage into a calibrated space and on the number of calibrated spaces passed through. For a weak strand it may be advantageous to provide close compression zones, the sweeping movement being maintained.

These successive compressions and decompressions take place according to the invention in the interior of a series of calibrated spaces.

According to one method of use the linear materials are led toward the interior of this series of calibrated spaces, and pass through the intervals separating the pairs of elements responsible for the drying, these intervals, such as grooves, causing a decompression after each compression.

An object of the invention likewise is an apparatus for the embodiment of the method defined hereabove.

This apparatus comprises:

two parts each having at least one rigid element, the element of one part being in such a position in relation to the corresponding element on the other part that these two elements are separated by a calibrated space and cooperate in the drying of the matter deposited on the linear materials;

means acting on the corresponding elements in order to control the calibrated space;

means for controlling the lateral movement of the linear materials in order to sweep the calibrated space; and tightening means maintaining the two parts of the apparatus and control means for the drying interval.

According to one particularly advantageous characteristic of the invention, the rigid elements forming a calibrated space between themselves are comprised of a ceramic material with a weak friction coefficient and, particularly, ceramic known on the market as TITAL sintered titanium oxide, reference $T_8$, state B, manufactured by the CERATEX Company).

According to another characteristic of the invention, these rigid elements are fixed onto plates maintained on a frame, this placement permitting voluntary selection of the form, number and spacing of the rigid elements.

Other characteristics and advantages of the invention will become apparent from the description which follows and which relates to forms of embodiment given as means of unlimited examples.

DESCRIPTION OF THE DRAWINGS

In this description, the attached drawings are referred to, in which.

DETAILED DESCRIPTION OF THE INVENTION

Figure 1:
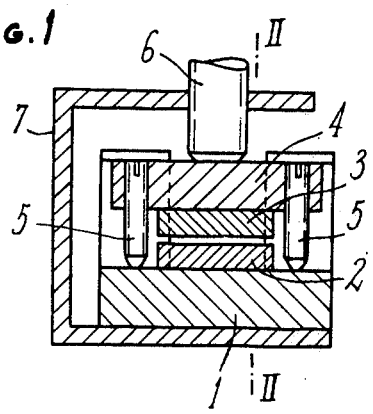
FIG. 1 is a cross-sectional view of the apparatus.
Figure 2:
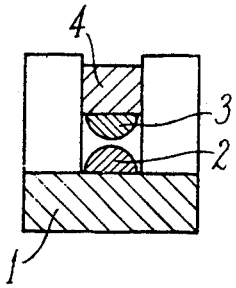
FIG. 2 is a longitudinal sectional view along line II—II of FIG. 1.

In the form of embodiment illustrated in FIGS. 1 and 2 the apparatus comprises a body 1 having substantially the shape of a "U" split on the sides. On the bottom of this body, along the axis of the split, the element 2 is situated forming the lower lip of the interval comprising the calibrated space.

The upper lip of this interval is itself comprised of the element 3 which is fixed to a parallelepidic block 4 introduced into the crevice of the body 1. Two screws 5 penetrate the block 4 permitting control of the interval between the lips 2 and 3 and consequently the calibrated space. This control is maintained by one screw 6 pressing on the block 4 and screwing into a piece 7 on which the body 1 rests.

The space between the lips 2 and 3 controlled by means of a thickness gauge, controls the weight percentage of matter deposited on the linear material.

The pieces 2 and 3 are of ceramic such as TITAL and have a half-circular shape, the diameter of which is 6 mm in the example under consideration; their contact with the linear material is brought about by the two face to face generating lines of the said pieces, which implicates that the material moves in the same plane upstream and downstream of the pieces 2 and 3. Practically no abrasion of the material takes place; the intensity of the drying is independent of the tension of the said material.

In order to prevent the formation of deposits of matter from the sides of the material in the calibrated space, which would lead to an uncontrolled modification of the percentage of matter applied to the said material, an alternating sweeping movement is transmitted to the material in the calibrated space. This movement assures the self-cleaning of this space and, in addition, permits the use of linear materials having surface irregularities.

Figure 4:
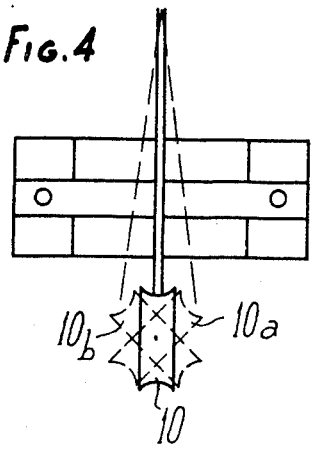
FIG. 4 is a plan view showing an apparatus conveying this sweeping movement to the material.

The sweeping movement can be obtained with any appropriate means such as, for example, as illustrated diarammatically in FIG. 4, a pulley 10 engaged by the material and movable betweeen two end positions 10*a* and 10*b*, this pulley having an axis of rotation which is inclined with respect to its plane of rotation. The sweeping movement can be likewise acquired with the help of a fork engaged by a cam device.

Figure 5:
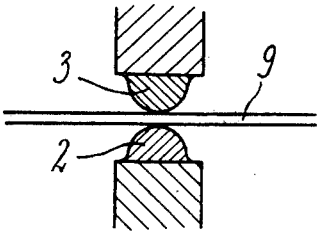
FIGS. 5, 6 and **6*a*** are detailed views relating to the direction of the material before and after its passage into the calibrated space.
Figure 3:
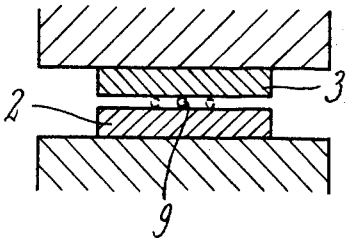
FIG. 3 is a sectional view showing the sweeping movement of the linear material in the calibrated space.

As illustrated in FIG. 5 the movement of the linear material 9 can be in one plane upstream and downstream of the calibrated space. The percentage of matter retained by the material is effected essentially by calendering and depends only on the calibrated space. It is independent of the material tension.

Figure 6:
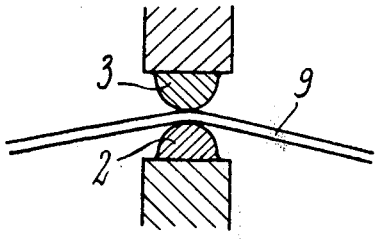
Figure 6A:
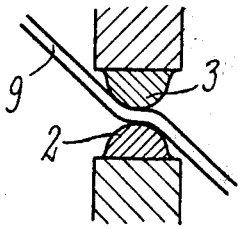

FIGS. 6 and 6*a* illustrate arrangements according to which the plane in which the material is moving upstream of the calibrated space is separate from the plane in which it is moving downstream. The percentage of matter retained by the material thus depends on the calibrated space as well as on the tension of the material. The drying takes place in this case by calendering and by pressure on the piece 2 in the case in FIG. 6 and on the pieces 2 and 3 in the case in FIG. 6*a*.

Figure 7:
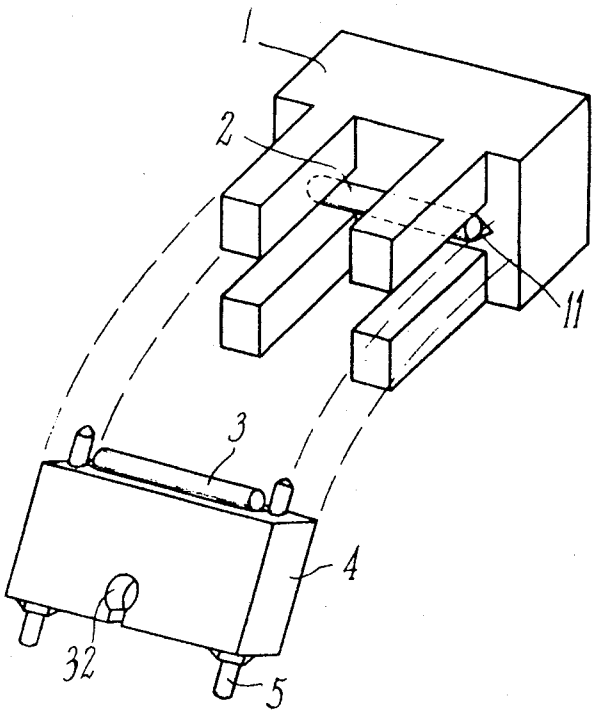
FIG. 7 is an enlarged view of a variation of the embodiment.

FIG. 7 shows a form of embodiment of the apparatus according to which the elements 2 and 3 forming the lips of the calibrated space are comprised of ceramic, cylindrical barrels, particularly of TITAL, fixed into grooves 11 provided respectively in the body 1 and the block 4.

Figure 8:
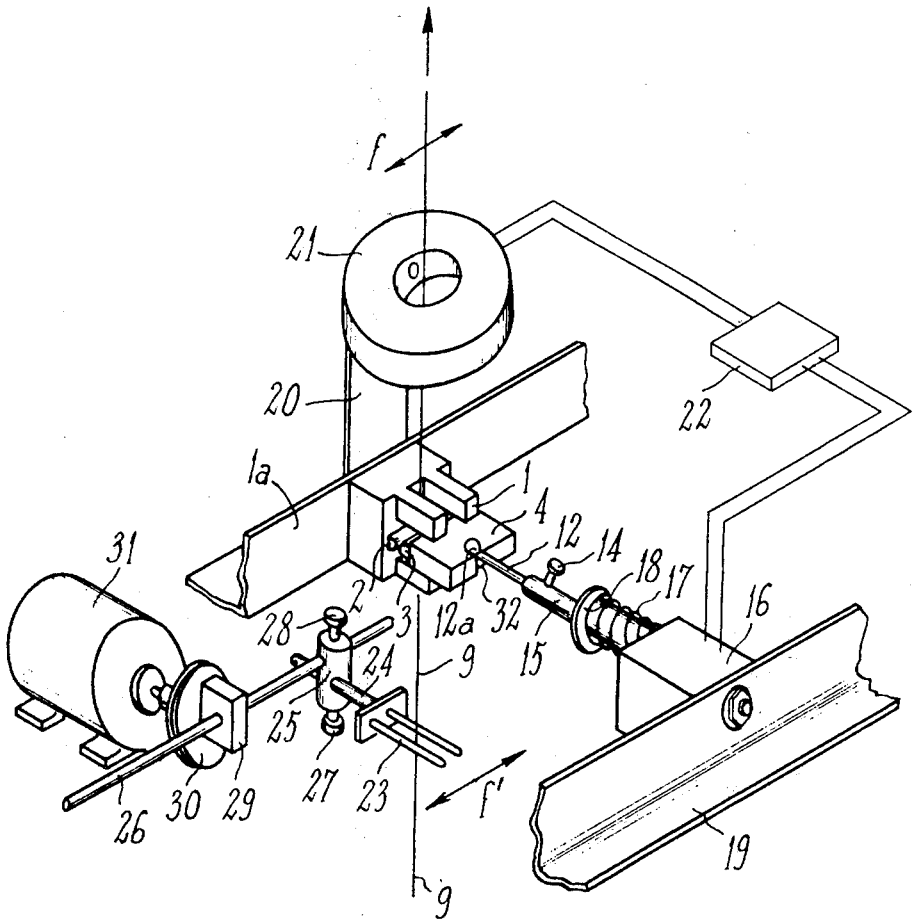
FIG. 8 is a view in perspective of a system for deactivating the apparatus in case the sweeping and the means assuring this sweeping are halted.

In the embodiment illustrated in FIG. 8 the apparatus responsible for controlling the sweeping comprises a fork 23 through which the linear material 9 passes. This fork is mounted by a rod 24 to a piece 25 itself mounted to a rod 26, screws 27 and 28 allowing control of the position of the fork.

The rod 26, which assures the alternating movement of the fork according to the arrows f', is fixed to a plate 29 mounted off center on the plate 30 activated into a rotating movement by the motor 31.

According to this same FIG. 8 the body 1 is fixed to a frame 1*a* and the block 4 is itself mounted to a rod 12 terminated by a head 12*a* engaged by a slot 32 provided in the block 4. The other end of the rod 12 is fixed by a screw 14 into a socket 15 mounted on the electromagnet 16 fixed to a frame 19. A spring 17 is provided between the body of this electromagnet and a ring 18 fixed to the rod 12.

On a cross-piece 20, fixed to the frame 1*a*, is mounted a vibration detector downstream of the calibrated space, crossed by the linear material 9. This detector is connected by a servocontrol apparatus to the electromagnet 16. When the sweeping movement of the calibrated space stops, that is when the linear material passes through the center of the detector without moving as shown by arrows f, the servo-control apparatus regulates the electromagnet 16 which pulls on the rod 12 while thus disengaging the element 3 borne by the block 4 from the element 2, itself borne by the body 1. When a defect immobilizes the strand in the calibrated space, the vibration detector causes the opening of this space until the defect passes.

Figure 10:
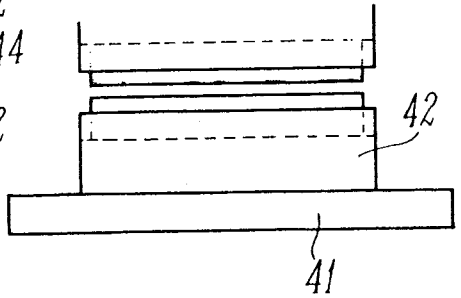
FIGS. 9, 10 and 11, are end, elevated, and plan views respectively of the support plates for the rigid elements bordering a succession of calibrated spaces.
Figure 9:
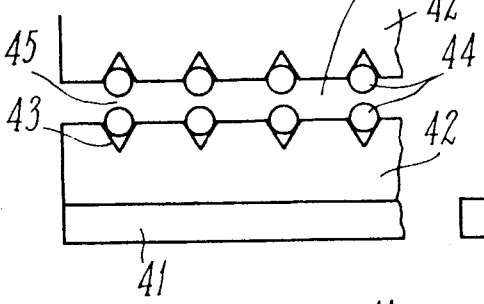
Figure 11:
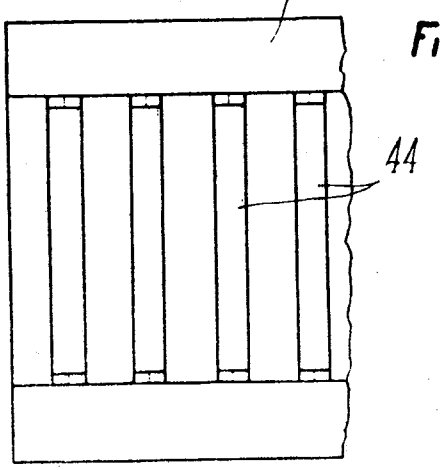

In the form of embodiment illustrated in FIGS. 9 to 11, a succession of separate calibrated spaces are provided so that the impregnated or coated linear materials are submitted to a succession of compressions and decompressions facilitating the elimination of excess matter.

In this form of embodiment, the apparatus contains a frame 41 holding two opposite plates 42. These plates display grooves 43 in which are attached ceramic, cylindrical small bars 44, particularly of TITAL. An inset piece, such as a thickness gauge, is provided between the two plates in order to maintain their spacing at a desired value corresponding to the calibrated space 45.

This arrangement allows for modification of the diameter, number and spacing of the small bars.

Between each pair of bars 44 a decompression interval 48 is located.

The example hereafter, given as a nonlimited example, illustrates the invention.

EXAMPLE

The drying of an assembly of glass fibers composed of five ES 9 68Z 25 strands, impregnated with an elastomeric mixture with the help of an apparatus identical to that described hereabove with reference to FIG. 1, the calibration gauge having a thickness of 20/100 millimeter and the speed of passage of the material being 100 meters per minute.

The impregnation mixture used, with a viscosity of 20 centipoises, was comprised as follows:

| Solution 1 | In Weight |
|---|---|
| water | 432.6 |

-continued

| Solution 1 | In Weight |
|---|---|
| resorcinol | 36.6 |
| 470 g/L of sodium hydroxide in a water solution | 2.2 |
| 30% formaldehyde solution | 66.6 |

The solution was permitted to set for four hours 30 minutes at 20° C. under agitation, then the following was added:

| | |
|---|---|
| 470 g/L sodium hydroxide in a water solution | 4.8 |
| Solution 2 | |
| water | 250.0 |
| S BR latex 40% (Firestone 251) | 342.0 |
| UGITEXVP 60% latex | 768.0 |
| ammonia 28% | 52.6 |

Solution 1 was poured into solution 2 under agitation.

The percentage of matter deposited on the assembly, after drying with repeated compression and expansion by exposure at a temperature of 120° C. for 0.8 seconds is 20%±0.5% with relation to the total weight of the material and the deposit.

I claim:

1. A method of controlling the quantity of a liquid such as an impregnant or coating applied to linear materials such as fibers, strands or the like comprising moving the linear material in a path which extends through a compression zone formed by a pair of elongated rigid elements disposed transversely of the path, the space between the elements being calibrated to permit passage of the linear material while effecting removal of liquid in excess of a predetermined amount, and imparting laterally sweeping movement to the linear material so that it sweeps the rigid elements within the compression zone as it moves linearly through the zone.

2. Method according to claim 1, characterized in that the lateral sweeping movement is communicated to the linear material upstream of the calibrated space.

3. Method according to claim 1, characterized in that the lateral sweeping movement accorded the linear material is an alternating to and fro movement.

4. Method according to claim 3, characterized in that the movement of the linear material is effected in the same plane upstream and downstream of the calibrated space, the drying taking place essentially by calendering.

5. Method according to claim 3, characterized in that the plane in which the linear material moves upstream of the calibrated space is separate from the plane in which it moves downstream, the drying taking place simultaneously by calendering and by pressure on at least one element bordering the calibrated space.

6. Method according to claim 1, characterized in that the linear material is passed between a plurality of pairs of elongated rigid elements spaced apart to effect a series of compressions and decompressions on said linear material.

* * * * *